US005095957A

United States Patent [19]

Herman

[11] Patent Number: 5,095,957

[45] Date of Patent: Mar. 17, 1992

[54] FLOTATION ASSEMBLY

[76] Inventor: Martin A. Herman, 2085 W. 114th St., Cleveland, Ohio 44102

[21] Appl. No.: 423,542

[22] Filed: Oct. 11, 1989

Related U.S. Application Data

[63] Continuation of Ser. No. 237,078, Aug. 29, 1988, Pat. No. 4,889,511.

[51] Int. Cl.[5] ..... B63C 9/12

[52] U.S. Cl. ..... 441/88; 441/106; 441/111; 441/117

[58] Field of Search ..... 441/88, 106, 111, 114–116, 441/117, 119, 32; 215/217, 228, 100 A, 100 R; 224/148

[56] References Cited

U.S. PATENT DOCUMENTS

| | | | |
|---|---|---|---|
| 150,189 | 4/1874 | Reid | 441/32 |
| 472,401 | 4/1892 | Rylands | 215/100 A |
| 980,176 | 12/1910 | Meno | 441/32 |
| 1,343,928 | 6/1920 | May | 441/119 |
| 4,889,511 | 12/1989 | Herman | 441/88 |

*Primary Examiner*—Sherman Basinger
*Attorney, Agent, or Firm*—Oldham & Oldham Company

[57] ABSTRACT

A flotation assembly designed to keep an individual afloat in water comprising a size adjustable harness adapted to fit the torso of an individual, to which are attached bottle closure devices. The closure devices are designed to have empty bottles inserted therein so as to form a substantially water-tight seal. The number of attached closure devices, and the size of the bottles inserted therein are chosen so that the degree of buoyancy desired is obtained, given the size of the individual and the purpose for which the buoyancy is required. Different types of closure devices are disclosed.

4 Claims, 2 Drawing Sheets

FIG.-7
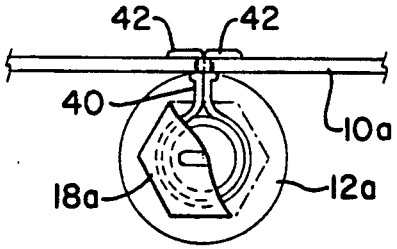
FIG.-8
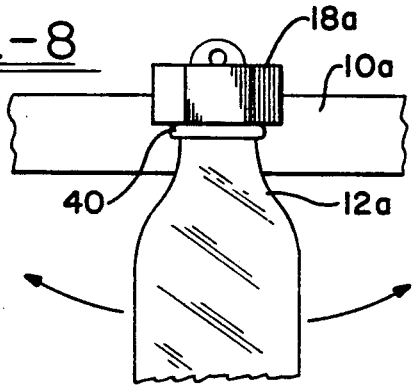
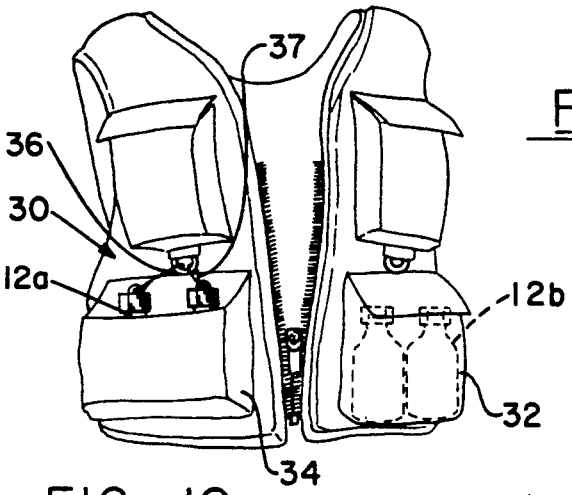
FIG.-10
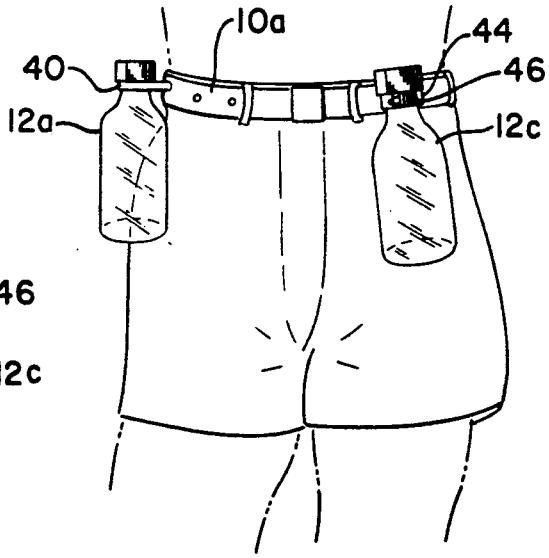
FIG.-9
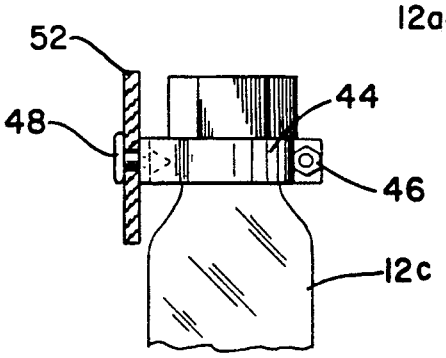
FIG.-11
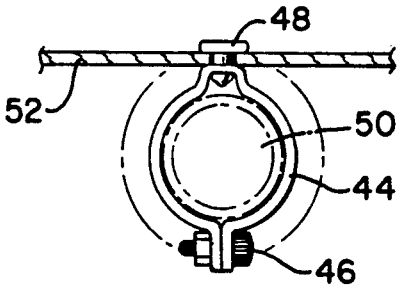
FIG.-12

FLOTATION ASSEMBLY

This is a continuation of Ser. No. 237,078 filed on Aug. 29, 1988, now U.S. Pat. No. 4,889,511.

TECHNICAL FIELD

This invention relates to a flotation assembly designed to assist a person in remaining afloat in the water with either no effort or with reduced effort. More specifically, this invention relates to bottle closure devices adapted for attachment to a harness designed to be worn by a person in the water. Sufficient numbers of such devices are attached to the harness so that empty bottles fastened thereto provide enough additional buoyancy to enable a person to remain afloat in water.

BACKGROUND ART

As is well known, many individuals in the general population have never learned to swim. In addition, many of those who have learned to swin are infirm, or at one time or another become incapacited or otherwise disabled. Also, many individuals in the process of learning to swim are greatly helped by using a flotation assembly capable of providing buoyancy assistance during the learning process. Finally, even those who know how to swim, and who are physically fit, have a limit to their physical endurance, and after being in the water for a prolonged period of time, they require some form of assistance if they are to remain afloat for periods beyond such limit.

In the past, many devices have been designed to provide buoyancy assistance. Among the better known devices are life jackets of one type or another, flotation rings, specially designed floats attached to the body of swimmers, and other devices.

While most such items have generally performed the service for which they were designed, they suffer from a number of disadvantages. They are, for example, relatively expensive. In addition, they are oftentimes not readily available to those who require them. Furthermore, such flotation devices are commonly bulky; consequently, many times they are not kept in places where they need to be, in order to be available when required. Also as is well known, some such devices do not stand aging well, and are sometimes useless or inoperable at the time of need.

DISCLOSURE OF INVENTION

A method has been found to fabricate a floatation assembly from readily available materials. The assembly is inexpensive and can be compactly stored, since its flotation components are separable from the body fastening component. Importantly, the degree of buoyancy can be variably adjusted to whatever degree of buoyancy is desired by the wearer, and the size of the body fastening component can be altered to fit varying body shapes and sizes.

These and other desirable characteristics, as will be evident from the remainder of the specification, are achieved in a flotation assembly which comprises:

a harness component, a plurality of bottle closure devices, means for attaching such closeure devices to said harness component, and empty bottles in numbers and size sufficient to impart the desired buoyancy to the wearer.

In a preferred embodiment, the harness component consists of a harness means worn about the waist, or disposed about the upper torso of the wearer, to which are fastened a number of bottle closure devices capable of having attached thereto a corresponding number of empty bottles, the number and size of the bottles being selected so that the buoyancy produced by the displacement of water by the bottles, and by the wearer, at least equals the buoyancy desired by the wearer.

In the illustrative embodiment, a size-adjustable harness component is fabricated from a water resistant material, and the closure devices are members fitted with a threaded opening adapted to have bottles with a threaded neck portion inserted in a substantially watertight relationship therein. Such closure devices are also adapted to be attached to the harness components at different locations on the harness, either by swivel snaps, by threading the closure device onto the harness, or by other means.

BRIEF DESCRIPTION OF THE DRAWINGS

This invention will be better understood when taken in conjunction with the drawings wherein:

FIG. 7 is a plan, partially broken away, of a further modification of the invention showing a bottle attached to a support belt;

FIG. 8 is a front elevation of the belt and bottle combination of FIG. 7;

FIG. 9 is a full elevation of the bottle and belt of FIG. 8 as worn by a person, and with the mechanism of FIG. 11 also shown;

FIG. 10 is an elevation of a vest and bottle combination forming a further embodiment of the invention;

FIG. 11 is a side elevation of a bottle as pivotally attached to a belt; and FIG. 12 is a plan view of the bottle as clamped to the belt of FIG. 11.

BEST MODE FOR CARRYING OUT THE INVENTION

Figure 1:
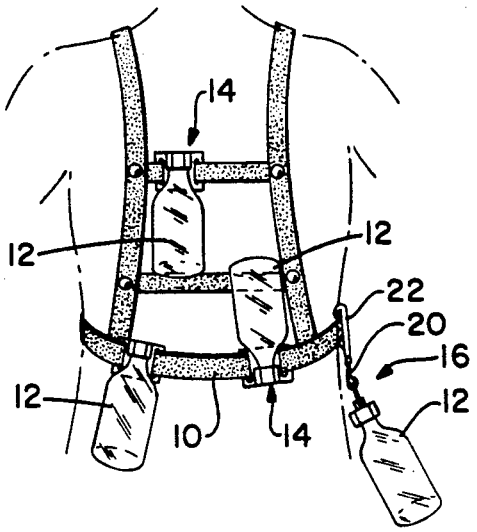
FIG. 1 shows the upper torso of a person wearing one form of a suitable harness with various bottle closure devices attached thereto, and to which empty bottles are attached.

FIG. 1 shows one variation of the harness 10 of the invention disposed about the person of a wearer. Fastened to the harness are several types of bottle closure devices. One of these 14 is of a type which is threaded onto the harness; the other 16 is attached to the harness with a swivel snap-loop arrangement. Both types have empty bottles 12 attached to the closure device. As is apparent from the drawing, the devices can be attached at various positions on the harness to suit the convenience and comfort of the wearer. The number of closure devices, and therefore bottles, can also be varied to suit the needs of the wearer. For example, for a person wearing the harness as an assist in learning to swim, less buoyancy, and therefore fewer bottles may be desired than in the case of someone wishing to be kept afloat in an emergency situation. The size of the bottles may also be chosen so as to provide desired variation in buoyancy.

Figure 2:
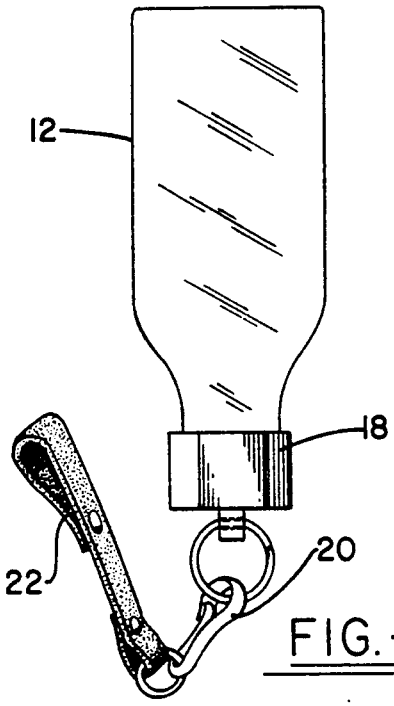
FIG. 2 shows a bottle closure device of a swivel snap-loop attachment type, to which an empty bottle is attached.

FIG. 2 shows a swivel snap-loop type closure device comprising a metal swivel snap fastener 20 attached to a harness loop 22 on one end and a threaded bottle cap 18 on the other end, by means of metal connecting rings. An empty bottle 12 is threadably engaged in cap 18, as shown. The harness commponent 10 of the flotation assembly is adapted to be threaded through the loop 22, so as to attach it thereto. The swivel snap-loop arrangement is particularly advantageous in that it is free to rotate and therefore it automatically adjusts its deployed position to that offering the most comfort to the wearer. The swivel snap also enables changes in the number of bottles to be easily and quickly accomplished.

Figure 3:
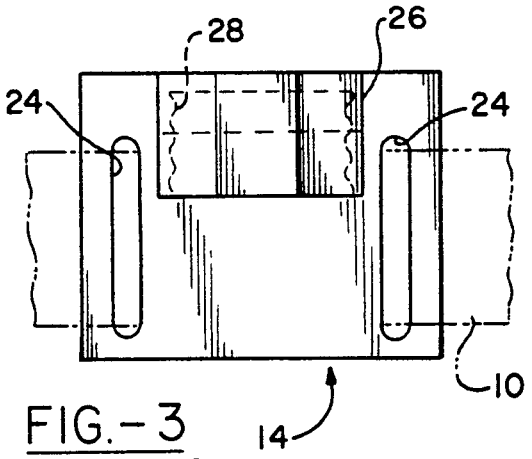
FIG. 3 shows a front elevation of a slotted bottle closure device adapted to be threaded onto the harness component by means of the slots in the device.

FIG. 3 shows the details of a bottle closure device which is designed to be fastened to the harness by having the harness threaded through slot-like openings 24 which slots are of a shape and size necessary to accommodate the harness 10. A threaded bottle cap portion 26 forms an integral part of the slotted bottle closure device.

Figure 4:
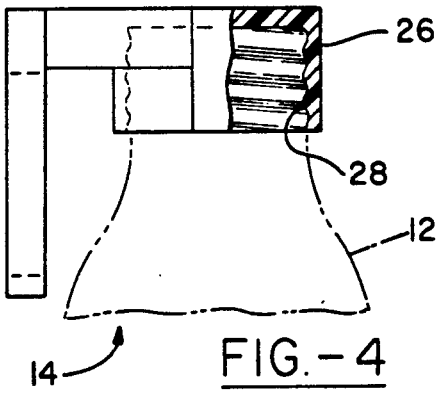
FIG. 4 shows a partial transverse cross section of a side elevation of the bottle closure device of FIG. 3.

FIG. 4 is a side elevation of the closure device of FIG. 3 in partial transverse cross-section, shows details of the threaded portion 28 of the device with a bottle 12 inserted therein.

Figure 5:
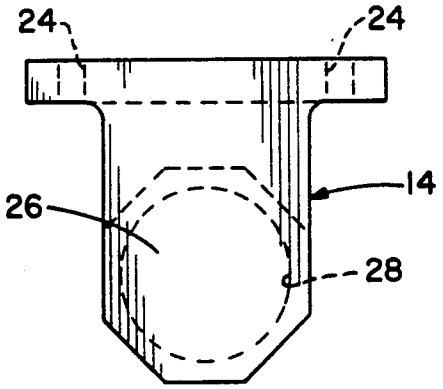
FIG. 5 shows a top plan view of the bottle closure device of FIG. 3.
Figure 6:
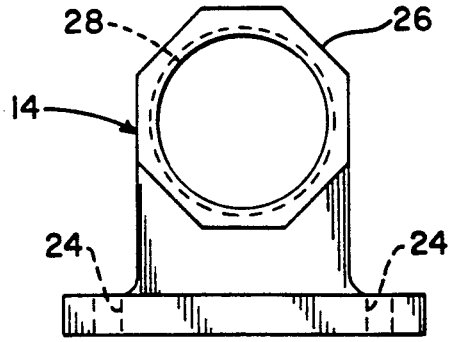
FIG. 6 is a bottom plan view of the bottle closure device of FIG. 3.

FIG. 5 is a top plan view of the closure device of FIG. 3, showing the hexagonal shape of the bottle cap portion of the device. The shape can be varied to suit the designer's personal esthetic preference, or it can be based on fabrication considerations. Consequently, it can be round, square or any other geometric shape desired.

The bottle closure devices of the invention may be fabricated from any of a variety of materials, such as plastic, rubber, etc. Among suitable plastics are nylon, polyethylene, polypropylene, polyvinyl chloride, fluorocarbon polymers such as teflon, and others having similar physical properties in the context of this invention. Plastic is especially preferred because it is dimensionally stable, easily formed to provide an excellent substantially water-tight seal, and is tough and not detrimentally affected by water. The threads in the bottle cap portion of the devices may either be molded therein or the device may have a threaded metal insert molded or pressed into such position.

Likewise, the harness may also be made from a number of different materials, leather, plastic and cloth being examples of suitable materials which retain their strength in water and are relatively unaffected by it. The harness may also be designed in a variety of shapes, as for example as an ordinary belt, a Sam Browne belt, some form of suspenders, as a modified parachute type harness, or a variation of one of the preceding. Desirably, the harness should incorporate means so that its size can be varied. In the case of a belt, for example, this could be accomplished by a buckle and a number of holes.

The precise form of attachment to the harness can also be varied considerably. Snap swivel-loop and slotted bottle closure devices are shown in the drawings; however, the closure device can be secured to the harness by means of adhesives, rivets, clamping, or otherwise. The swivel snap-loop is particularly desirable because of its deployment characteristics, previously described, and both it and the slotted variant have the especially desirable characteristic of being easily removed from, or added to the harness to suit the wearer's buoyancy needs.

The bottles found useful for the purposes of the invention may be selected from a large variety of types, including many of those to be found in the ordinary home. Their volume and shape may be varied, it only being necessary that they have necks adapted to being fitting into the corresponding closure devices. For example, with threaded closure devices the necks of the bottles should likewise be threaded. In addition, considerable latitude may be exercised in selecting the bottles to be fastened to the closure devices. They may, for instance, be made from a wide variety of plastics, or from glass. Suitable plastics include materials such as, for example, polyvinyl chloride, polyethylene terphthalate, polyethylene, polypropylene, polystyrene, ABS and others. It will be appreciated that plastic bottles are especially advantageous for use in the invention, since they are light and less easily damaged than glass bottles.

The invention also contemplates use of a vest, preferably tubular or of a continuous body engaging construction, made from plastic or light weight fabric. The vest would have a plurality of zipper closed pockets of a size to receive air or gas carrying, closed bottles therein. Conventional crimped compressed bottle caps may be used as bottle closures and the pockets could be made to be on the outside or inside of the vests as desired and pockets could be present in the chest area of the vest on the front and/or back thereof.

In FIG. 7 a modification is shown wherein a bottle **12*a* is affixed to a harnass or belt 10*a* by means of a clamp wire or piece 40 that has a portion of its length tightly engaged to the neck of the bottle and with its ends 42** extending through a hole in the belt and being folded over to retain the assembly together and permit the bottle to swing through an arc in a vertical plane.

FIG. 9 shows how this structure of FIG. 7 can be used to position the bottle on a wearer's belt.

Another bottle **12*c*** is also shown in FIG. 9 to show how the structure of FIG. 3 can be used for positioning a bottle on a wearer.

With reference to FIG. 10, it shows a conventional vest 30 of any suitable type. This vest has a pocket 32 provided therein and it can be closed by any suitable means, such as Velcro material or the like and which pocket 32 is sized so as to receive one or two bottles **12*b* therein. Theses bottles have any desired closures thereon and provide a nice lifting or buoying effect for the wearer of the vest. A somewhat different size pocket 34, which may have an opened top, is also formed in the vest and it has a pair of bottles 21 positioned therein. These bottles have caps thereon whereby a tie 36 can go through an aperture in the cap as in FIG. 2 and be used for securing these bottles to an anchor member 37** on the vest.

FIG. 11 shows yet a further modification of the present structure wherein a cap 50 has a clamp member 44 extending therearound and which clamp member pivotally engages with a rivet 48 that is secured to the belt 52 in this unit. Any desired type of a bolt or clamp closure means 46 is associated with the clamp for removably securing it around the neck of the bottle and/or cap thereon. The cap or plastic body 50 has screw air tight engagement with a conventional bottle and aids in securing the bottle to a belt, vest or other harnass.

The bottles or containers preferably are made of a slightly flexible plastic material.

While in accordance with the patent statutes, a preferred embodiment and best mode has been presented, the scope of the invention is not limited thereto, but rather is measured by the scope of the attached claims.

What is claimed is:

1. A life vest flotation assembly comprising a harness having a waist belt, a pair of shoulder straps and at least one generally horizontal connecting strap between the shoulder straps, at least one bottle having a threaded neck portion, at least one bottle closure device having a hollow generally cylindrical portion with one open end wherein said cylindrical portion is threaded for engagement with the threaded neck of said bottle and said closure device including an integral coupling means thereon, an attachment component comprising a flexible unit having a releasable attachment loop therein and a snap fastener coupled to said flexible unit wherein said attachment loop may be selectively coupled to said harness and said snap fastener may be selectively coupled to said coupling means on said closure device.

2. The flotation assembly of claim 1, wherein, said coupling means of said closure device comprises a lug formed on said closure device with an aperture formed therein, and a connecting ring movably positioned in said aperture for coupling to said snap fastener.

3. The flotation assembly of claim 1, wherein said closure device is formed of a plastic material with said coupling means integrally formed therewith.

4. The flotation assembly of claim 1, wherein the threaded cylindrical portion is present in the form of a threaded metal insert.

* * * * *